US011782383B2

(12) United States Patent
Matsumaru et al.

(10) Patent No.: US 11,782,383 B2
(45) Date of Patent: Oct. 10, 2023

(54) PROCESS CARTRIDGE

(71) Applicant: CANON KABUSHIKI KAISHA, Tokyo (JP)

(72) Inventors: Naoki Matsumaru, Shizuoka (JP); Yu Akiba, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/960,890

(22) Filed: Oct. 6, 2022

(65) Prior Publication Data

US 2023/0115381 A1 Apr. 13, 2023

(30) Foreign Application Priority Data

Oct. 12, 2021 (JP) ..... 2021-167625

(51) Int. Cl.
*G03G 21/18* (2006.01)
*G03G 21/16* (2006.01)

(52) U.S. Cl.
CPC ..... *G03G 21/186* (2013.01); *G03G 21/1647* (2013.01); *G03G 21/1825* (2013.01); *G03G 21/1864* (2013.01); *G03G 2221/1657* (2013.01)

(58) Field of Classification Search
CPC ..... G03G 21/186; G03G 21/1647; G03G 21/1825; G03G 21/1864; G03G 2221/1657
See application file for complete search history.

(56) References Cited

U.S. PATENT DOCUMENTS

| | | | | |
|---|---|---|---|---|
| 6,963,706 | B2 | 11/2005 | Morioka et al. | |
| 7,062,195 | B2 | 6/2006 | Kurihara et al. | |
| 7,203,442 | B2 | 4/2007 | Matsubara et al. | |
| 8,238,784 | B2 | 8/2012 | Kusudo et al. | |
| 8,311,449 | B2 | 11/2012 | Kusudo et al. | |
| 9,052,638 | B2 | 6/2015 | Matsumaru et al. | |
| 9,417,604 | B2 | 8/2016 | Matsumaru et al. | |
| 10,409,214 | B2 * | 9/2019 | Lee | G03G 15/06 |
| 10,627,780 | B2 | 4/2020 | Fujiwara et al. | |
| 10,678,184 | B2 | 6/2020 | Murakami et al. | |
| 10,691,063 | B2 * | 6/2020 | Maeshima | G03G 21/1857 |
| 10,732,545 | B2 * | 8/2020 | Takeuchi | G03G 15/0894 |
| 10,901,366 | B2 | 1/2021 | Murakami et al. | |
| 10,928,751 | B2 | 2/2021 | Akiba et al. | |

(Continued)

FOREIGN PATENT DOCUMENTS

JP 2012-137790 A 7/2017

*Primary Examiner* — Francis C Gray
(74) *Attorney, Agent, or Firm* — Venable LLP

(57) ABSTRACT

Provided is a process cartridge where a developing unit includes a coupling member that receives driving force, a driving transmission member that transmits the driving force from the coupling member to a driving roller, and a support member that rotatably supports the coupling member and is movable with respect to a developing frame in a direction intersecting with a rotational axis of the developing roller. The developing frame and the driving transmission member are configured to be movable with respect to a drum frame of a drum unit in the direction intersecting the rotational axis. In this process cartridge, an urging member that engages with both the support member and the drum frame is included such that an urging force is applied in a direction in which a positioned portion of the support member and a positioning portion of the drum frame contact each other.

9 Claims, 13 Drawing Sheets

(56) References Cited

U.S. PATENT DOCUMENTS

| | | | | |
|---|---|---|---|---|
| 10,962,927 | B2 | 3/2021 | Fujiwara et al. | |
| 11,449,001 | B2 | 9/2022 | Fujiwara et al. | |
| 2004/0028429 | A1 | 2/2004 | Matsumaru | |
| 2015/0277370 | A1* | 10/2015 | Maeshima | G03G 21/1842 399/279 |
| 2020/0301352 | A1 | 9/2020 | Matsumaru et al. | |
| 2021/0341875 | A1* | 11/2021 | Takeuchi | G03G 21/1676 |
| 2021/0397122 | A1* | 12/2021 | Fukui | G03G 21/1814 |
| 2022/0171328 | A1* | 6/2022 | Kakuta | G03G 21/1814 |

* cited by examiner

PROCESS CARTRIDGE

BACKGROUND OF THE INVENTION

Field of the Invention

The present disclosure relates to a process cartridge detachably attached to an electrophotographic image forming apparatus main body.

Description of the Related Art

In an image forming apparatus, such as a copier and a printer, that uses an electrophotographic system, an apparatus configuration where a photosensitive member and a processing unit that acts on the photosensitive member are integrated as a process cartridge, and this process cartridge is detachably attached to the electrophotographic image forming apparatus main body. In such a process cartridge type apparatus configuration, it is widely proposed that a developing apparatus is configured to be oscillatable around a photosensitive drum, and the developing roller is contacted to the photosensitive drum by pressing the developing apparatus toward the photosensitive drum side using a pressing unit. Further, Japanese Patent Application Publication No. 2012-137790 proposes a configuration that an Oldham's coupling is used for an end portion of a developing roller, and a pressing member is used to hold the Oldham's coupling at a predetermined position when the process cartridge is inserted into the image forming apparatus main body.

SUMMARY OF THE INVENTION

The present invention is to further advance the above mentioned conventional technique, and an object thereof is to provide a process cartridge that is capable of stably pressing the developing roller against the photosensitive drum.

To achieve this object, the process cartridge detachably attached to the image forming apparatus main body according to the present invention, comprising:

a drum unit including a photosensitive drum and a drum frame configured to rotatably support the photosensitive drum; and a developing unit, the developing unit including:

a developing roller;

a developing frame configured to rotatably support the developing roller;

a driving transmission portion including a coupling member and a driving transmission member, where the coupling member (i) is disposed on a side of an end portion of the developing frame in a direction of a rotational axial line of the developing roller, (ii) is rotatable, and (iii) receives a driving force to rotate the developing roller from the apparatus main body, and the driving transmission member is rotatable and transmits the driving force transmitted from the coupling member to the developing roller, and the driving transmission portion is configured such that the coupling member and the driving transmission member are relatively movable in a direction intersecting with the rotational axial line; and a support member configured to rotatably support the coupling member and to be disposed movably with respect to the developing frame and the driving transmission member in the direction intersecting with the rotational axial line, wherein the developing frame and the driving transmission member are configured to be integrally movable between a contacted position and a separated position to/from the drum frame in the direction intersecting with the rotational axial line, the developing roller is contacted with the photosensitive drum in a case where the developing frame and the driving transmission member are at the contacted position, and the developing roller is separated from the photosensitive drum in a case where the developing frame and the driving transmission member are at the separated position, wherein the support member includes a positioned portion, wherein the drum frame includes a positioning portion, where the positioning portion positions the support member with respect to the drum frame by contacting with the positioned portion in the direction intersecting with the rotational axial line, wherein the process cartridge includes an urging member that is engaged with both the support member and the drum frame, so that the urging force is applied in the direction where the positioned portion of the support member and the positioning portion of the drum frame contact.

According to the present invention, a process cartridge that is capable of stably pressing the developing roller against the photosensitive drum can be proposed.

Further features of the present invention will become apparent from the following description of exemplary embodiments with reference to the attached drawings.

DESCRIPTION OF THE EMBODIMENTS

In the following embodiment, examples of the present disclosure will be described. The configuration disclosed in the following embodiment, such as the function, material, shape and relative position of each component, indicates an example of an aspect related to the claims, and is not intended to limit the scope of the claims to the configuration disclosed in the embodiment. Further, the problems solved by the configuration disclosed in the following embodiment or the functions or effects acquired by the disclosed configuration are not intended to limit the scope of the claims.

Embodiment 1

An electrophotographic image forming apparatus according to Embodiment 1 of the present disclosure will be described with reference to the drawings. Here the electrophotographic image forming apparatus (hereafter image forming apparatus) is an apparatus that forms an image on a recording material using the electrophotographic image forming system. Examples of the image forming apparatus include a copier, facsimile, printer (e.g. laser printer, LED printer) and a composite machine thereof (multi-function printer) and the like. The recording material includes recording paper, and a sheet type recording medium, such as a plastic sheet. Further, the image forming apparatus according to the present embodiment is a cartridge system-based image forming apparatus. The cartridge is a unit detachably attached to the image forming apparatus, and includes a photosensitive member and a process unit (e.g. charging member, developing member, cleaning member) that acts on the photosensitive member. In the following embodiment, a laser beam printer, to which four process cartridges (cartridges) are detachably attached, will be described as an example of the image forming apparatus. A number of process cartridges attached to the image forming apparatus is not limited to this, and may be set appropriately as required.

General Configuration of Image Forming Apparatus M

Figure 2:
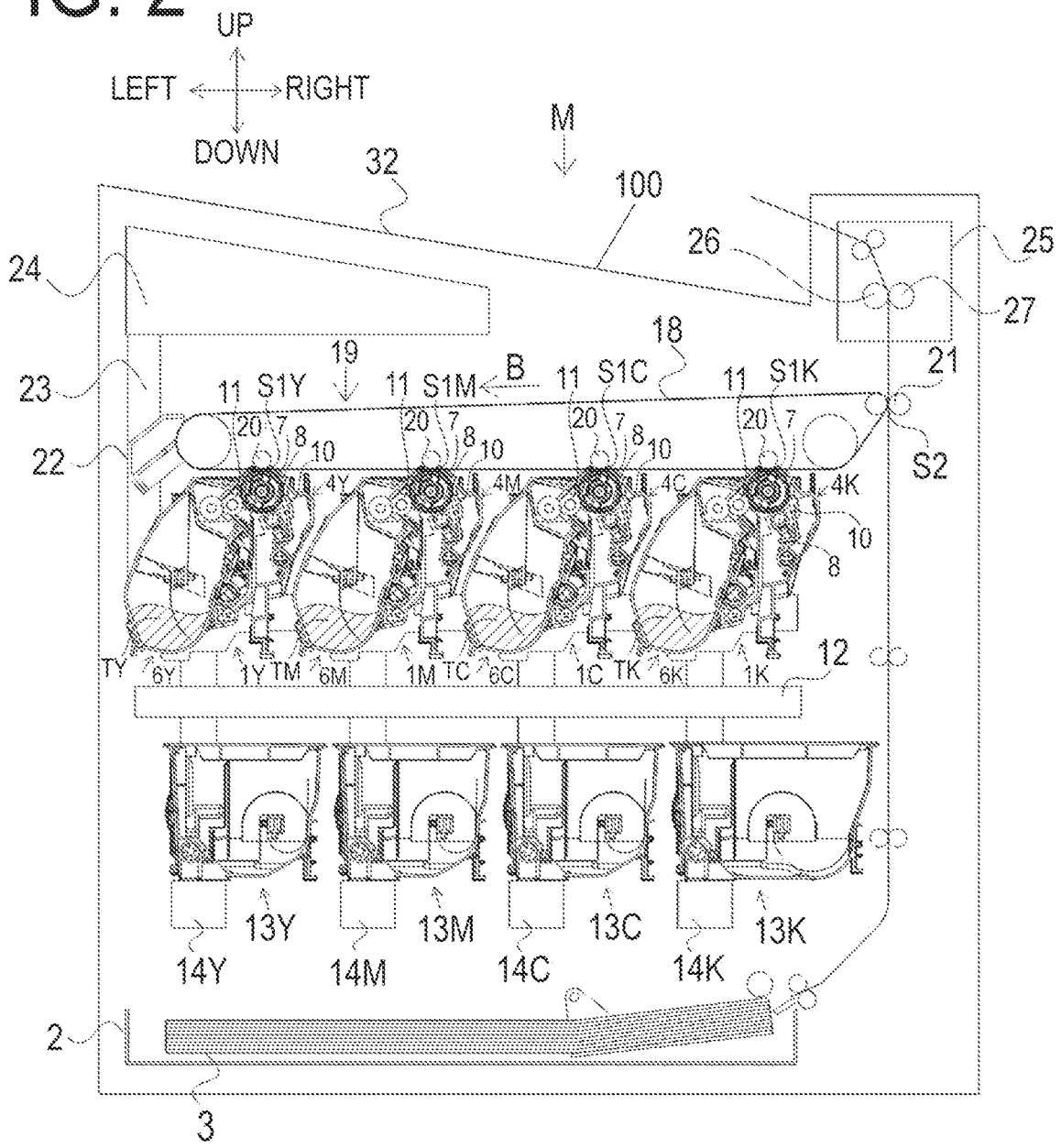
FIG. 2 is a schematic cross-sectional view of the image forming apparatus according to the embodiment of the present invention.
Figure 3:
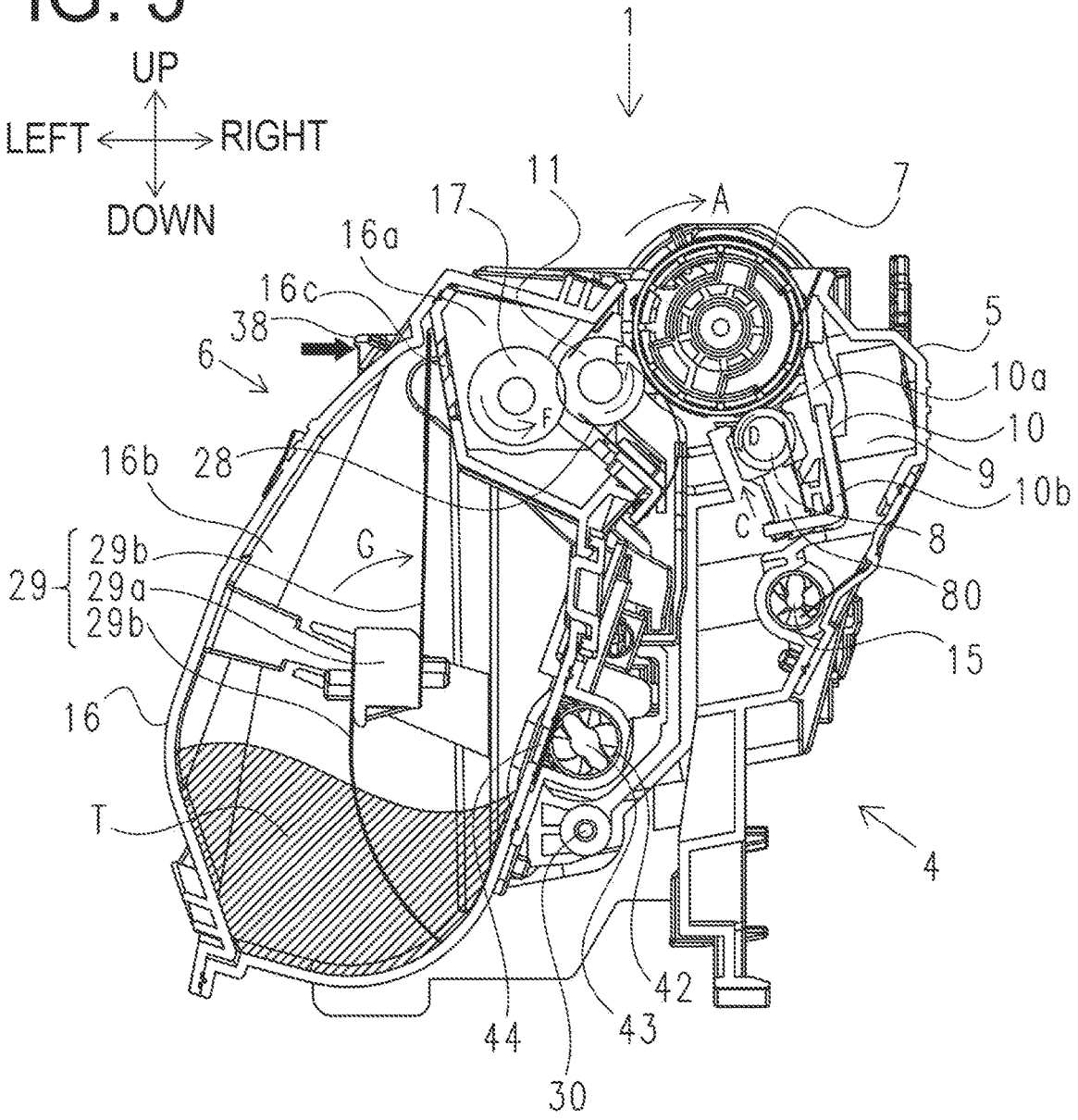
FIG. 3 is a cross-sectional view of the process cartridge of the embodiment of the present invention.

A general configuration of an electrophotographic image forming apparatus M (hereafter image forming apparatus M) according to an embodiment of the present invention will be described with reference to FIG. 2 and FIG. 3. FIG. 2 is a schematic cross-sectional view of the image forming apparatus M according to the present embodiment (apparatus main body 100, process cartridge 1, toner cartridge 13). FIG. 3 is a schematic cross-sectional view of the process cartridge 1.

The image forming apparatus M according to the present embodiment is a four-color type full color laser printer using the electrophotographic process, and forms color images on a recording material S. The image forming apparatus M is a process cartridge type, where the process cartridge 1 is detachably attached to the image forming apparatus main body (apparatus main body) 100, so as to form a color image on the recording material S. In the present embodiment, the process cartridge 1 and the toner cartridge 13 are removable attached to the apparatus main body 100 of the image forming apparatus M.

Here it is assumed that the right side of the illustration in FIG. 2 is the front face of the image forming apparatus M, and the left side of the illustration is the rear face, which is the opposite side of the front face, of the image forming apparatus M. When the image forming apparatus M is viewed from the front face in this state, the right side is the driving side and the left side is the non-driving side. Further, when the image forming apparatus M is viewed from the front face, the upper side is the upper face and the lower side is the lower face. FIG. 2 is a cross-sectional view when the image forming apparatus M is viewed from the non-driving side, and the front side when viewed facing the illustration is the non-driving side of the image forming apparatus M, and the rear side thereof is the driving side of the image forming apparatus M.

The driving side of the process cartridge 1 is the side where the later mentioned drum coupling member (photosensitive coupling member) is disposed with respect to the photosensitive drum axial line direction (rotational axial line direction of the photosensitive drum). The driving side of the process cartridge 1 is the side where a later mentioned developing coupling member is disposed with respect to the developing roller (developing member) shift line direction (rotational axial line direction of the developing roller). The photosensitive drum axial line direction and the developing roller axial line direction are parallel with each other, and the longitudinal direction of the process cartridge 1 (photosensitive drum, developing roller) is also parallel therewith.

In the present embodiment, the process cartridge is provided for each of the four colors (yellow (Y), magenta (M), cyan (C) and black (K)) of toner, in order to form color images, and constitutes each of the first to fourth image forming portions respectively. The configuration and operation of the first to fourth image forming portions are substantially the same, except the color of the image to be formed is different. Therefore unless a special differentiation is required, the suffixes Y, M, C and K are omitted in the following description.

The first to fourth process cartridges 1 are disposed side by side in the horizontal direction. Each process cartridge 1 includes a drum unit (also called a cleaning unit) 4 and a developing unit 6. The drum unit 4 includes a photosensitive drum 7 (an image bearing member), a charging roller 8 (a charging member) that uniformly charges the surface of the photosensitive drum 7, and a cleaning blade 10 (a cleaning member). The developing unit 6 includes a developing portion that houses a developing roller 11 and developer T (hereafter toner), and develops an electrostatic latent image on the photosensitive drum 7. The drum unit 4 and the developing unit 6 support each other, so as to be oscillatable from each other. A first process cartridge 1Y contains yellow (Y) toner in the developing unit 6. In the same manner, a second process cartridge 1M contains magenta (M) toner, a third process cartridge 1C contains cyan (C) toner, and a fourth process cartridge 1K contains black (K) toner.

The process cartridge 1 is detachably attached to the apparatus main body 100 via an attaching member, such as an attachment guide (not illustrated) and a positioning member (not illustrated) disposed on the apparatus main body 100. A scanner unit 12, to form an electrostatic latent image, is disposed below the process cartridge 1. Further, a waste toner conveying unit 23 is disposed behind the process cartridge 1 in the apparatus main body 100 (downstream side in the insertion direction of the process cartridge 1).

The first to fourth toner cartridges 13 are disposed below the process cartridges 1, and are disposed side by side in the horizontal direction in the sequence corresponding to the color of the toner contained in each process cartridge 1. The first toner cartridge 13Y contains the yellow (Y) toner. In the same manner, the second toner cartridge 13M (contains the magenta (M) toner, the third toner cartridge 13C contains the cyan (C) toner, and the fourth toner cartridge 13K contains the black (K) toner. Each toner cartridge 13 replenishes the toner to the process cartridge 1 containing the corresponding color of toner.

The toner cartridge 13 is replenished when a residual amount detecting portion (not illustrated) disposed in the apparatus main body 100 of the image forming apparatus M detects that a residual amount of toner in the process cartridge 1 is insufficient. The toner cartridge 13 is detachably attached to the apparatus main body 100 via attaching member, such as an attaching guide (not illustrated) and a positioning member (not illustrated) disposed in the apparatus main body 100. The process cartridge 1 and the toner cartridge 13 will be described in detail later.

The first to fourth toner conveying units 14 are disposed below the toner cartridges 13, so as to correspond to each toner cartridge 13. Each toner conveying apparatus 14 conveys toner, received from each toner cartridge 13, upward, and supplies the toner to each developing unit 6.

An intermediate transfer unit 19 (intermediate transfer member) is disposed above the process cartridge 1. The intermediate transfer unit 19 is disposed approximately in the horizontal position with a primary transfer portion S1 side downward. An intermediate transfer belt 18, which faces each photosensitive drum 7, is a rotatable endless belt, and is stretched over a plurality of stretching rollers. A primary transfer roller 20 (primary transfer member) is disposed on the inner surface of the intermediate transfer belt 18 at a position where each primary transfer roller 20 and each photosensitive drum 7 form the primary transfer portion S1 via the intermediate transfer belt 18. A secondary transfer roller 21 (secondary transfer member) contacts with the intermediate transfer belt 18 and forms a secondary transfer portion S2 with a roller on the opposite side via the intermediate transfer belt 18. Further, an intermediate transfer belt drum unit 22 is formed on the opposite side of the secondary transfer portion S2 in the left and right directions (directions in which the intermediate transfer belt is stretched on the second transfer portion S2).

Further, a fixing unit 25 is disposed above the intermediate transfer unit 19. The fixing unit 25 is constituted of a heating unit 26 and a pressure roller 27 that press-contacts with the heating unit 26. A discharging tray 32 is disposed on the upper face of the apparatus main body 100, and a waste toner collecting container 24 is disposed between the discharging tray 32 and the intermediate transfer unit 19. Further, a paper feeding tray 2, to house recording material 3, is disposed at the lowest portion of the apparatus main body 100.

Image Forming Process

An image forming operation of the image forming apparatus M of the present embodiment will be described with reference to FIG. 2 and FIG. 3.

When an image is formed, each photosensitive drum 7 is rotary-driven at a predetermined speed in the arrow A direction indicated in FIG. 3. The intermediate transfer belt 18 is rotary-driven in the arrow B direction (forward direction of the rotation of the photosensitive drum 7).

First the surface of the photosensitive drum 7 is uniformly charged by the charging roller 8. Then the surface of the photosensitive drum 7 is scanned and exposed with the laser light emitted from the scanner unit 12, whereby an electrostatic image based on the image information is formed on the photosensitive drum 7. The electrostatic latent image formed on the photosensitive drum 7 is developed as a toner image by the developing unit 6. At this time, the developing unit 6 is pressed by a developing pressure unit (not illustrated) disposed on the apparatus main body 100 side, and is maintained in a predetermined contacting state to the drum unit 4 to develop the toner image. The toner image formed on the photosensitive drum 7 is primarily transferred onto the intermediate transfer belt 18 by the primary transfer roller 20.

For example, when a full color image is formed, the above mentioned process is sequentially performed in the image forming portions S1Y to S1K (first to fourth primary transfer portions), whereby a toner image of each color is sequentially superimposed on the intermediate transfer belt 18.

The recording material 3 housed in the paper feeding tray 2, on the other hand, is fed at a predetermined control timing, and is conveyed to the secondary transfer portion S2 synchronizing with the movement of the intermediate transfer belt 18. Then the four-color toner images on the intermediate transfer belt 18 are secondarily transferred onto the recording material 3 in batch by the secondary transfer roller 21, which is contacted to the intermediate transfer belt 18 via the recording material 3.

Then the recording material 3, on which the toner image is transferred, is conveyed to the fixing unit 25. The toner image is fixed to the recording material 3 by the fixing unit 25 heating and pressing the recording material 3. Then the fixed recording material 3 is conveyed to the discharging tray 32, thereby the image forming operation completes.

Here the primary untransferred toner (waste toner) remaining on the photosensitive drum 7 after the primary transfer step is removed by the cleaning blade 10. The secondary untransferred toner (waste toner) remaining on the intermediate transfer belt 18 after the secondary transfer step is removed by the intermediate transfer belt drum unit 22. The waste toner removed by the cleaning blade 10 and the intermediate transfer belt drum unit 22 is conveyed by a waste toner conveying unit 23 disposed on the apparatus main body 100, and is stored in the waste toner collecting container 24.

The image forming apparatus M of the present embodiment can form a single color image or a multi-color image using only a desired single or a few (not all) of the image forming portions.

Process Cartridge

Figure 4:
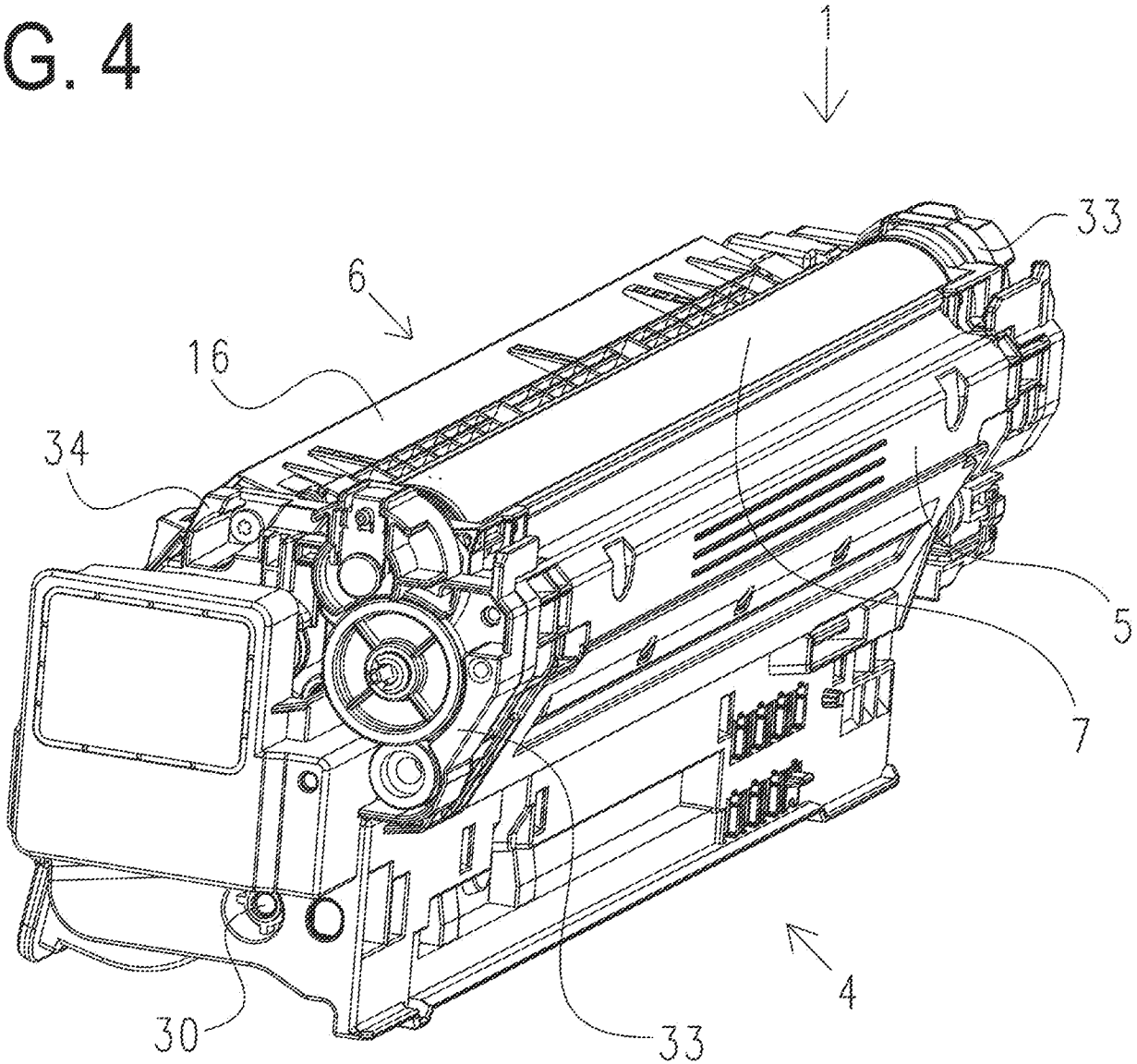
FIG. 4 is a perspective view of the process cartridge of the embodiment of the present invention.
Figure 5:
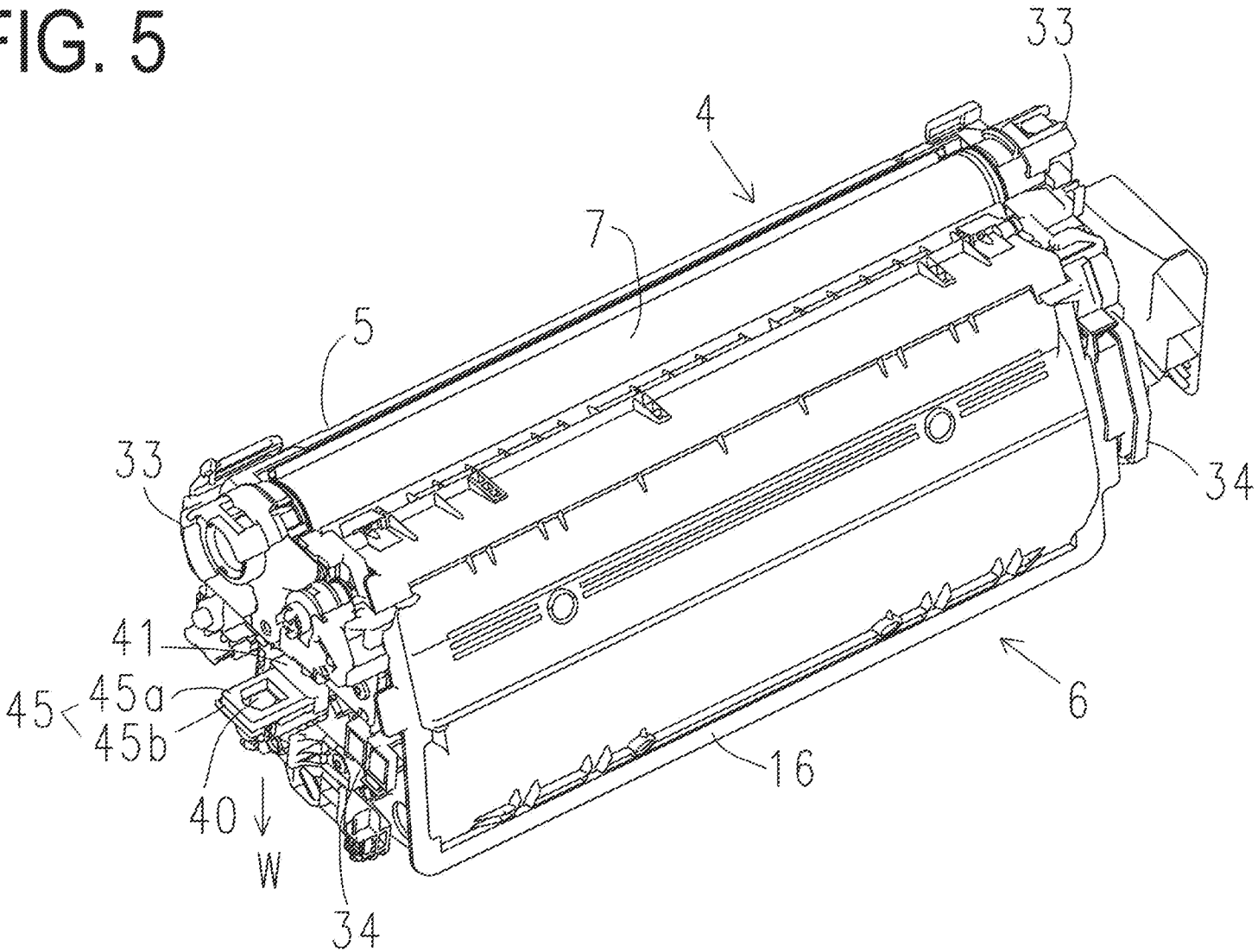
FIG. 5 is a perspective view of the process cartridge of the embodiment of the present invention.
Figure 6:
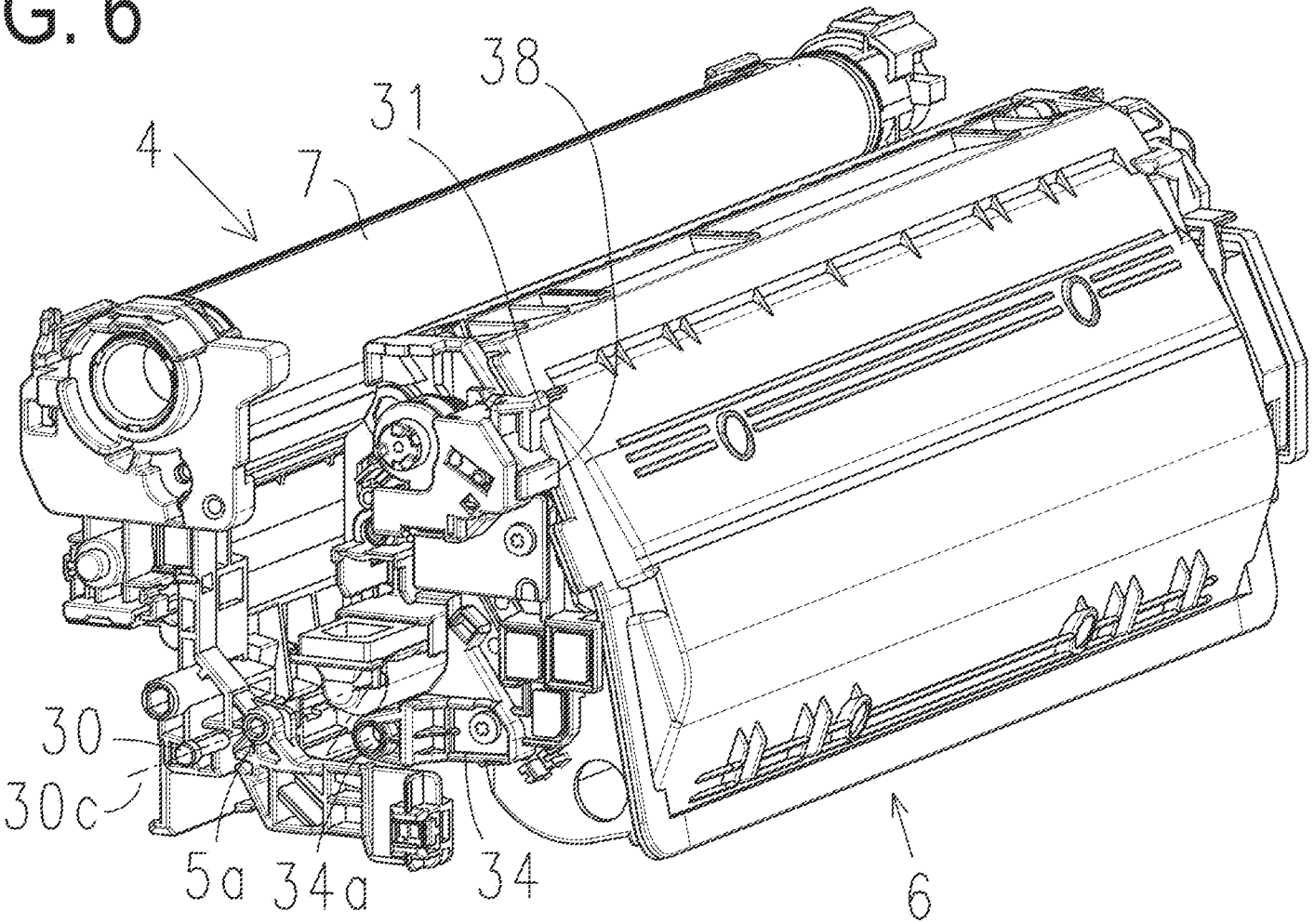
FIG. 6 is a perspective view of the process cartridge of the embodiment of the present invention.

A general configuration of each process cartridge 1 that is attached to the apparatus main body 100 of the image forming apparatus M according to the present embodiment will be described with reference to FIGS. 3 to 6. FIG. 4 is a perspective view of the process cartridge 1 when viewed obliquely from the upper rear side (upstream side in the insertion direction of the process cartridge, non-driving side). FIG. 5 is a perspective view of the process cartridge 1 when viewed obliquely from the upper front side (downstream side in the insertion direction of the process cartridge, driving side). FIG. 6 is a perspective view of the process cartridge 1 when viewed obliquely from the upper front side, in a state before the developing unit 6 is connected with the drum unit 4.

The process cartridge 1 includes the drum unit 4 and the developing unit 6.

The drum unit 4 includes a drum unit frame (drum frame) 5 that supports various members in the drum unit 4. The drum unit 4 includes a waste toner screw 15 that extends in a direction which is parallel with the rotational axial direction of the photosensitive drum 7, in addition to the photosensitive drum 7, the charging roller 8 and a cleaning blade 10. In the drum unit frame 5, a drum support member 33, which is a bearing member that rotatably supports the photosensitive drum 7 and includes a gear train to transmit driving from the photosensitive drum 7 to the waste toner screw 15, is disposed on both ends of the drum unit 4 in the longitudinal direction.

The charging roller 8 disposed in the drum unit 4 is urged by a charging roller pressure spring 80 in the arrow C direction toward the photosensitive drum 7. The charging roller 8 is disposed so as to follow the movement of the photosensitive drum 7, and rotates in the arrow D direction (forward direction of the rotation of the photosensitive drum 7) when the photosensitive drum 7 is rotary-driven in the arrow A direction when an image is formed.

The cleaning blade 10 disposed on the drum unit 4 is constituted of an elastic member 10*a* to remove untransferred toner (waste toner) remaining on the surface of the photosensitive drum 7 after the primary transfer, and a support member 10*b* to support the elastic member 10*a*. The waste toner, which the cleaning blade 10 removed from the surface of the photosensitive drum 7, is contained in a waste toner container 9 constituted of the cleaning blade 10 and a drum unit frame 5. The waste toner contained in the waste toner container 9 is conveyed by the waste toner screw 15, which is disposed inside the waste toner container 9, in the direction toward the rear side (downstream side in the insertion direction of the process cartridge 1) of the apparatus main body 100. The conveyed waste toner is discharged from a waste toner discharging portion (not illustrated), and is transferred to the waste toner conveying unit 23 of the apparatus main body 100.

The developing unit 6 includes a developing frame 16 that supports various members inside the developing unit 6. The inner space of the developing frame 16 is separated into a developing chamber 16*a* in which the developing roller 11 and a feeding roller 17 are disposed, and a toner container 16*b* (developer containing portion) in which the toner is contained and a stirring member 29 is disposed.

The developing roller 11, the feeding roller 17 and a developing blade 28 are disposed in the developing chamber 16*a*. The developing roller 11 carries the toner, and when an image is formed, the developing roller 11 conveys toner to the photosensitive drum 7 by rotating in the arrow E direction and contacting with the photosensitive drum 7. The developing roller 11 is also rotatably supported on the developing frame 16 at both end portions of the longitudinal direction (rotational axial line direction) by a developing bearing unit 34. The feeding roller 17 is rotatably supported on the developing frame 16 by a developing bearing unit 34 while contacting with the developing roller 11, and rotates in the arrow F direction when an image is formed. Further, a developing blade 28 (layer thickness regulating member), to regulate the thickness of the toner layer formed on the developing roller 11, is disposed so as to contact with the surface of the developing roller 11.

The stirring member 29, to stir the contained toner T and convey the toner to the feeding roller 17 via a developing chamber connecting opening 16*c*, is disposed in the toner container 16*b*. The stirring member 29 includes a rotating shaft 29*a* which is parallel with the developing roller 11 in the rotational axial line direction, and a stirring sheet 29*b* (conveying member) which is a flexible sheet. One end of the stirring sheet 29*b* is mounted on the rotating shaft 29*a*, the other end of the stirring sheet 29*b* is a free end, and the toner is stirred by the stirring sheet 29*b* by the rotating shaft 29*a*, rotating and turning the stirring sheet 29*b* in the arrow G direction.

The developing unit 6 includes the developing chamber connecting opening 16*c* which connects the developing chamber 16*a* and the toner container 16*b*. In the present embodiment, the developing chamber 16*a* is located above the toner container 16*b* in a state where the developing unit 6 is normally used (state during operation). The toner inside the toner container 16*b* drawn up by the stirring member 29 is supplied to the developing chamber 16*a* via the developing chamber connecting opening 16*c*.

Further, a toner receiving port 40 is disposed on one end of the developing unit 6 in the insertion direction (FIG. 5). A receiving port seal member 45 and a toner receiving port shutter 41, which can be moved forward/backward in the inserting direction of the process cartridge 1, are disposed on the upper part of the toner receiving port 40. The receiving port seal member 45 is constituted of a fiber member 45*a* (e.g. polyester) and an elastic member 45*b* (e.g. sponge), and is fixed to the toner receiving port 40 using fixing member (e.g. double-sided tape). In a case where the process cartridge 1 is not attached to the apparatus main body 100, the toner receiving port 40 is closed by the toner receiving port shutter 41. The toner receiving port shutter 41 is configured to be urged toward the apparatus main body 100 interlocking with the insertion operation of the process cartridge 1, whereby the toner receiving port shutter 41 is opened.

When the process cartridge 1 is attached to the apparatus main body 100, the receiving port seal member 45 contacts with the toner feeding port (not illustrated) of the apparatus main body 100, and is compressed in the W direction indicated in FIG. 5. By the elastic force generated by compression of the receiving port seal member 45 when compressed, the receiving port seal member 45 and the toner feeding port are sealed, so as to prevent toner from scattering around the toner receiving port 40 area. The toner discharged from the toner cartridge 13, which will be described later, is conveyed through a toner conveying path (not illustrated) formed inside the apparatus main body 100, and is fed to the process cartridge 1 via the toner receiving port 40.

As illustrated in FIG. 3, a receiving conveying path 42 that is connected to the toner receiving port 40 is disposed in the developing unit 6, and a receiving conveying screw 43 is disposed therein. Further, a container connecting opening 44, to feed toner to the toner container 16*b*, is disposed near the center of the developing unit 6 in the longitudinal direction, so as to connect the receiving conveying path 42 and the toner container 16*b*. The receiving conveying screw extends parallel with the rotational axial line direction of the developing roller 11 and the feeding roller 17, so as to convey the toner received from the toner receiving port 40 to the toner container 16*b* via the container connecting opening 44.

The developing unit 6 and the drum unit 4 described above are connected to be oscillatable around a predetermined rotational axial line. Specifically, as illustrated in FIG. 6, holes 34*a* and 5*a* are formed on both end portions of the developing bearing unit 34 and the drum unit frame 5 respectively in the longitudinal direction, and are connected via a rotation support pin 30. In FIG. 6, only one side in the longitudinal direction of this oscillating shaft support configuration is illustrated, but a similar shaft support configuration is also disposed on the opposite side (the other side in the longitudinal direction). Thereby the developing bearing unit 34 is supported, so as to be oscillatable from the drum unit 4 with a center axis 30*c* of the rotation support pin 30 (hereafter first rotating shaft) as an axial line.

Figure 1:
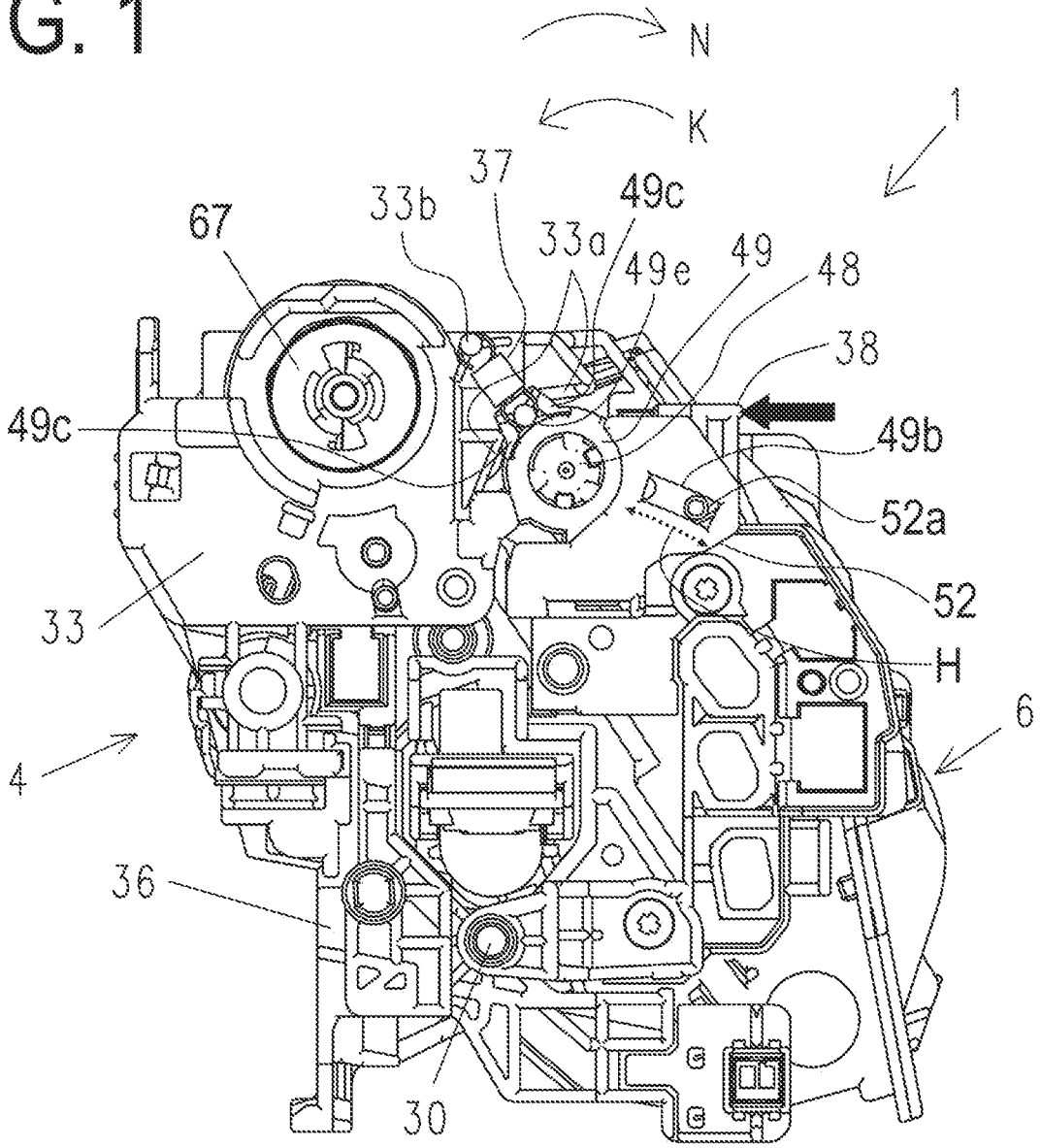
FIG. 1 is a side view of a process cartridge according to an embodiment of the present invention.

In the process cartridge 1, a pressed portion 38 is formed in the process cartridge to perform the oscillating operation by the above mentioned shaft support configuration, and the photosensitive drum 7 and the developing roller 11 are configured to be contacted or separated by the operating force from the apparatus main body 100. In other words, when an image is formed, the pressed portion 38 formed in the developing frame 16 is pressed by a pressing mechanism (not illustrated) disposed in the apparatus main body 100, so that the rotation moment in the K direction indicated in FIG. 1 is applied to the developing unit 6 via the rotation support pin 30. Thereby the developing unit 6 can be placed at a first position (contact position or adjacent position) where the developing roller 11 contacts with or is close to the photosensitive drum 7. On the other hand, when the image forming process ends and the pressure applied by the pressing mechanism of the apparatus main body 100 clears, the developing unit 6 is placed at a second position (separated position), where the developing roller 11 is separated from the photosensitive drum 7, by the weight of the developing unit 6.

Toner Cartridge

Figure 7:
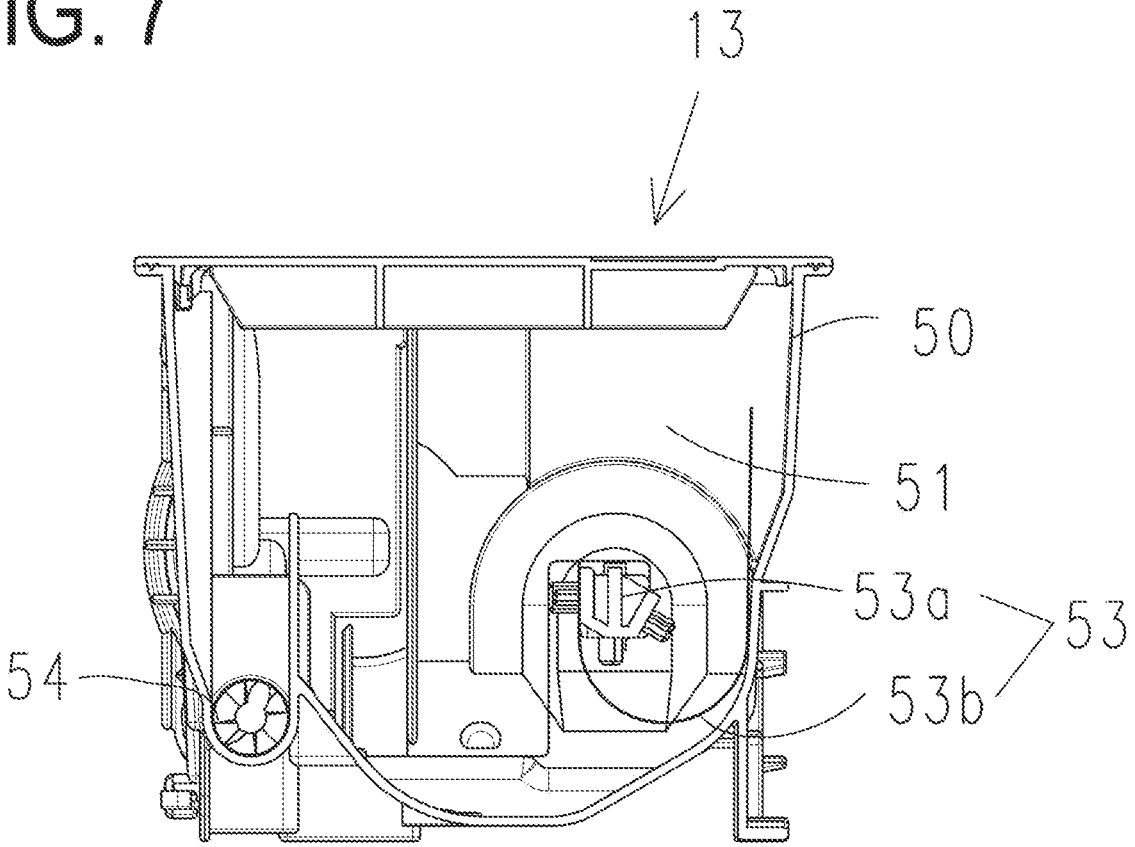
FIG. 7 is a cross-sectional view of a toner cartridge.

The toner cartridge 13 according to the present embodiment will be described with reference to FIG. 7. FIG. 7 is a cross-sectional view of the toner cartridge according to the present embodiment.

The toner cartridge 13 includes a replenishing frame 50 that supports various members in the toner cartridge 13, and a replenishing toner container 51 that contains toner therein. A replenishing toner stirring member 53 and a replenishing toner conveying screw 54 are disposed inside the replenishing toner container 51.

The replenishing toner stirring member 53 is disposed parallel with the longitudinal direction of the toner cartridge 13, and is rotatably supported in the replenishing frame 50. The replenishing toner stirring member 53 includes a rotating shaft 53*a* and a replenishing stirring conveying sheet 53*b* made of a flexible sheet. Toner is conveyed to the replenishing toner conveying screw 54 by the rotating shaft 53*a*, which rotates and makes the replenishing stirring conveying sheet 53*b* rotate.

The replenishing toner conveying screw 54 is disposed parallel with the rotational axial line of the replenishing toner stirring member 53, and is rotatably supported on the replenishing frame 50. By rotating, the replenishing toner conveying screw 54 conveys the toner inside the replenishing toner container 51 from the front side to the rear side (from the upstream side to the downstream side in the insertion direction of the toner cartridge). The conveyed toner is discharged from the toner discharging port disposed on the downstream side of the replenishing toner conveying screw 54 to the toner conveying path inside the apparatus main body 100. As mentioned above, the toner discharged to the toner conveying path inside the apparatus main body 100 is replenished into the developing unit 6 via the toner receiving port 40 indicated in FIG. 5.

Coupling Member on the End Portion of Feeding Roller

Figure 8:
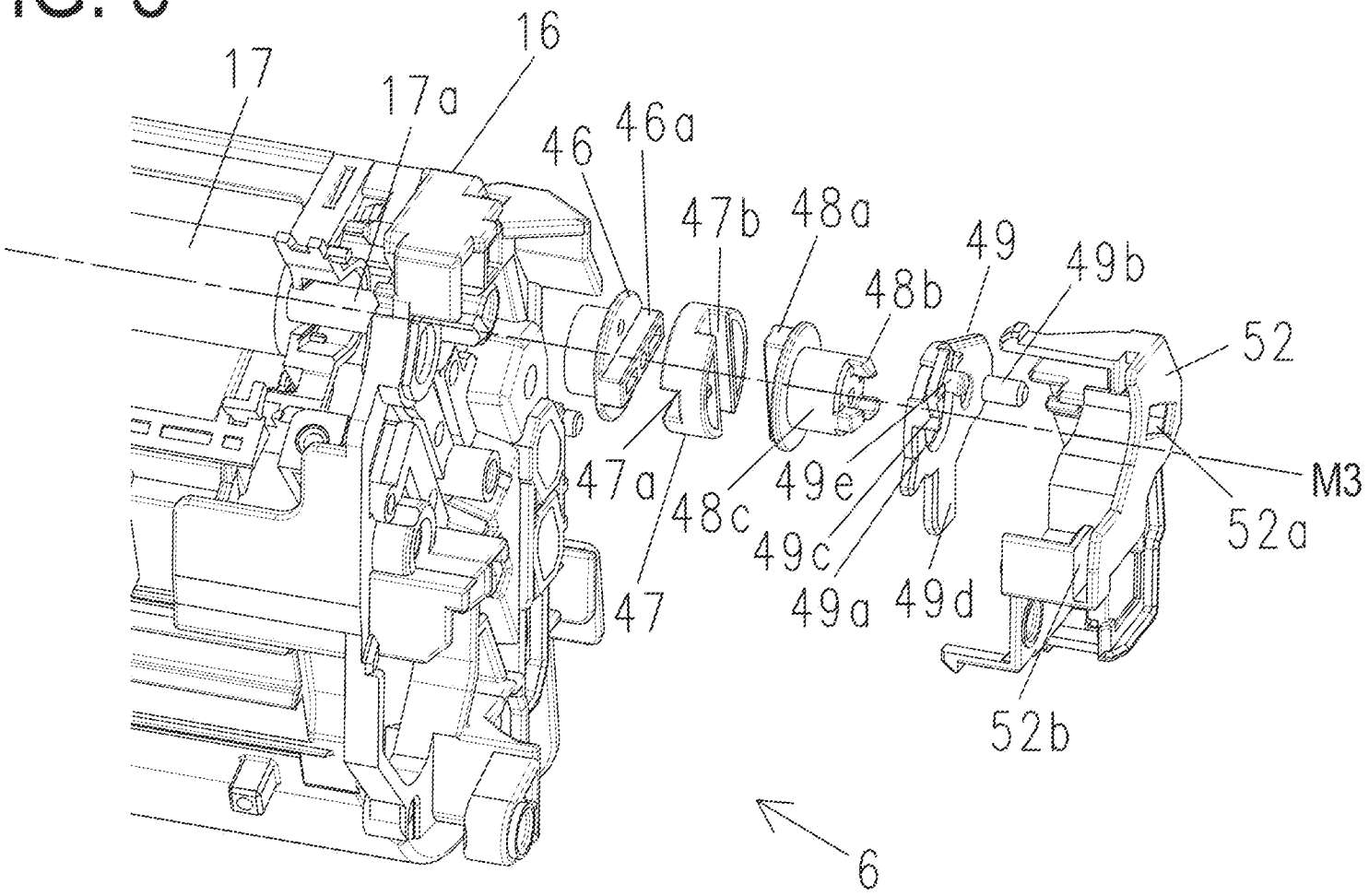
FIG. 8 is a diagram depicting a configuration of a coupling unit according to the embodiment of the present invention.
Figure 9:
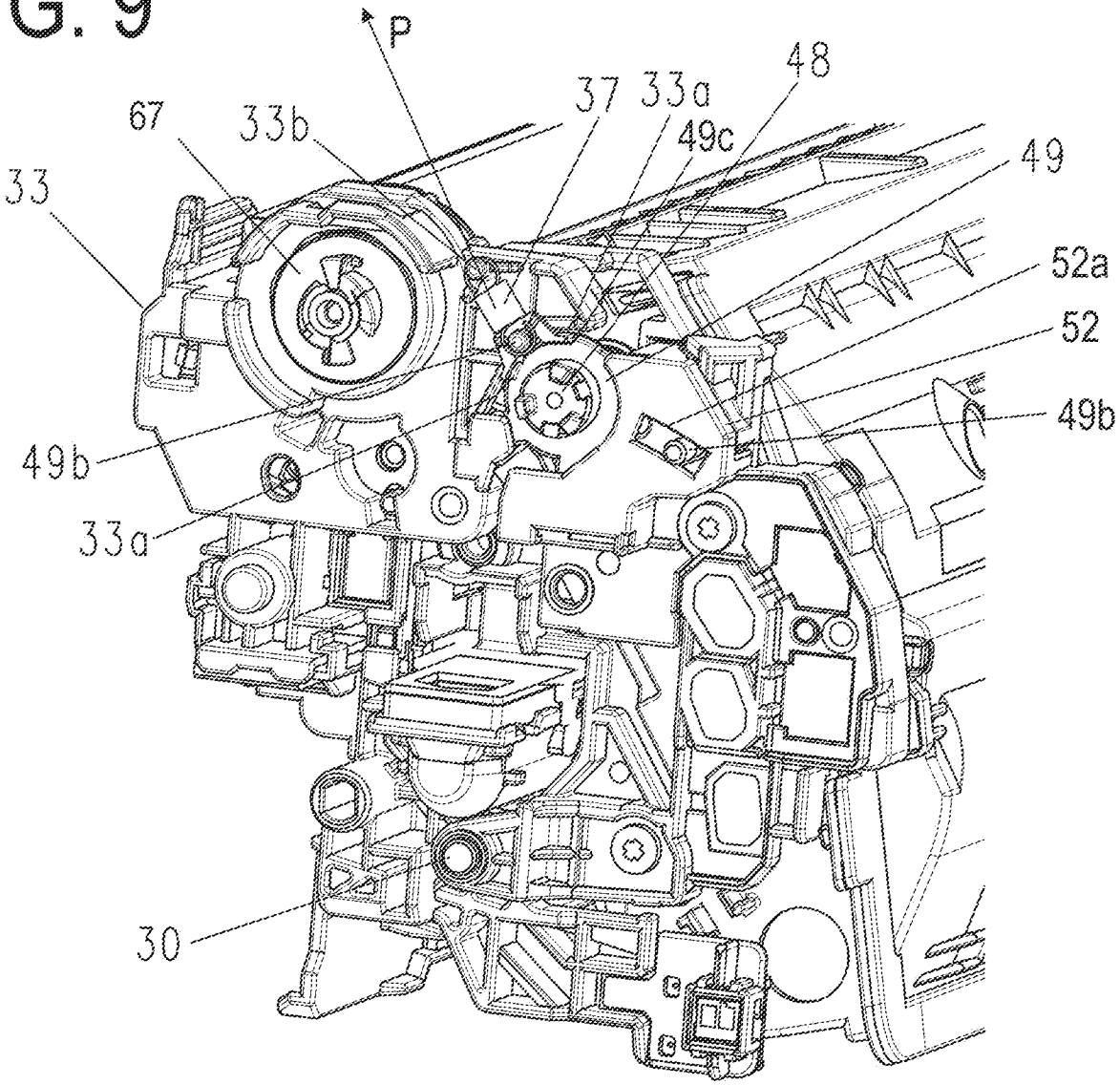
FIG. 9 is a perspective view depicting a configuration of a side face on the driving side of the process cartridge according to the embodiment of the present invention.
Figure 10:
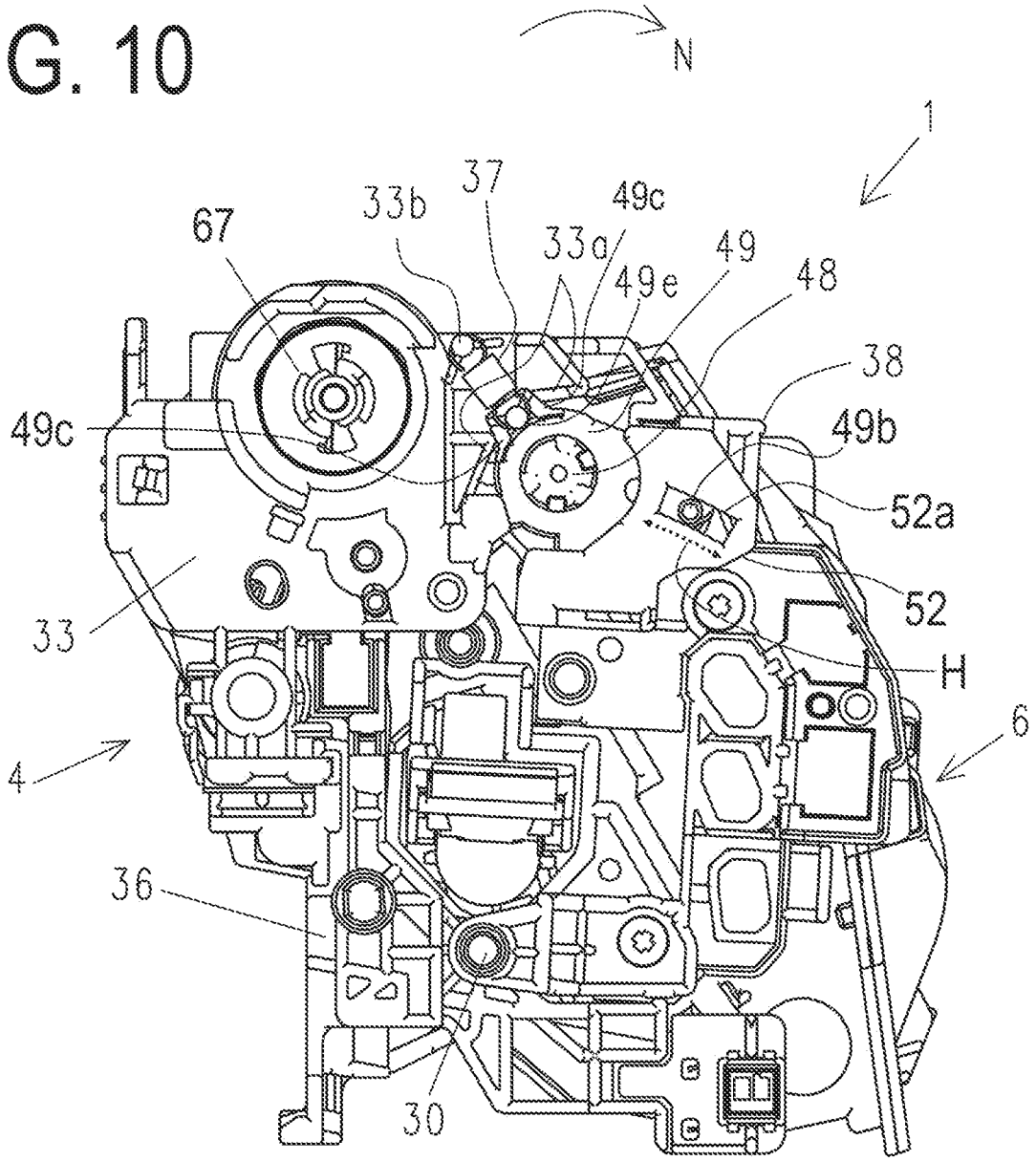
FIG. 10 is a side view on the driving side of the process cartridge according to the embodiment of the present invention.
Figure 11:
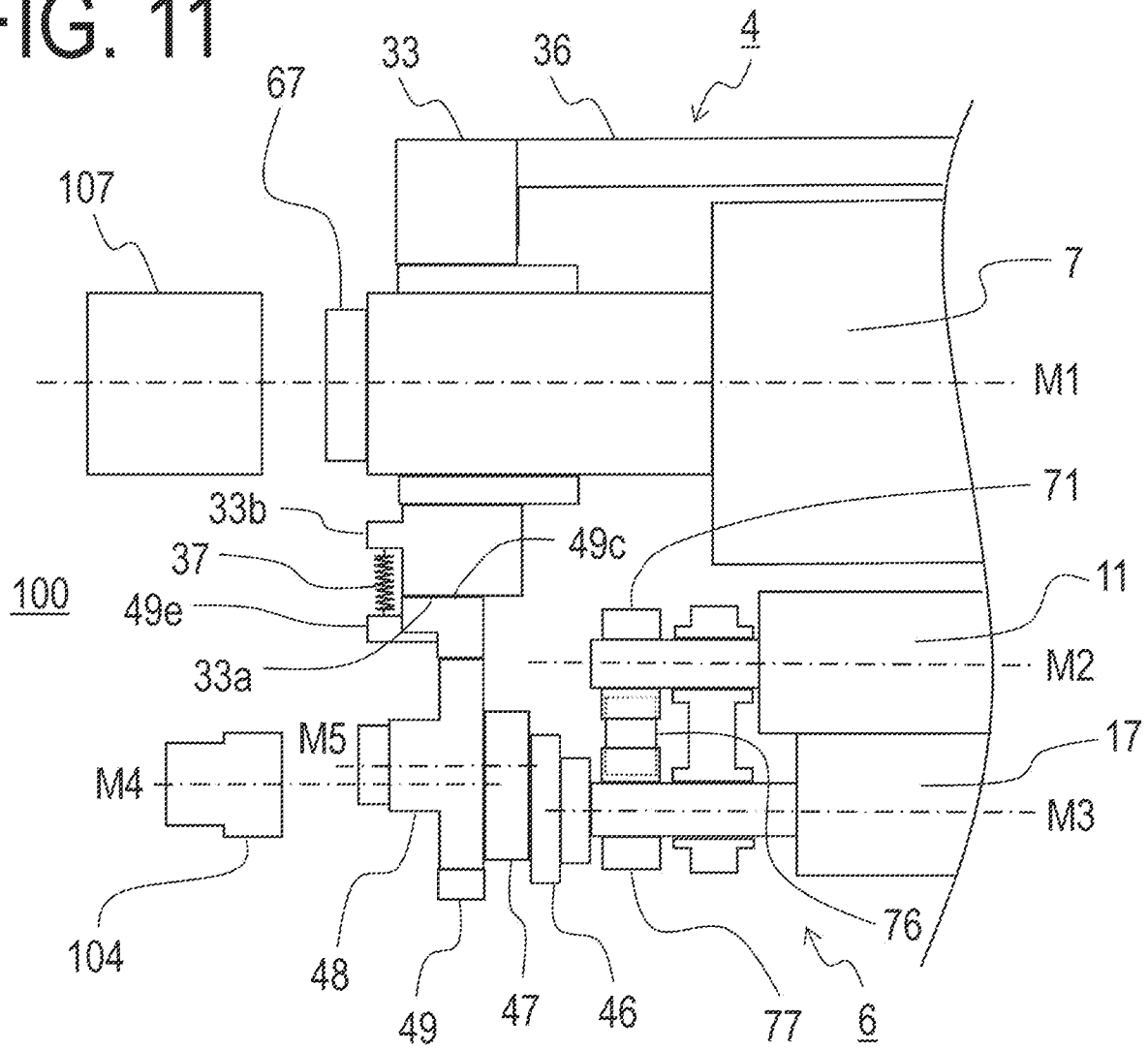
FIG. 11 is a schematic diagram depicting a driving mechanism between the apparatus main body and the process cartridge.
Figure 12:
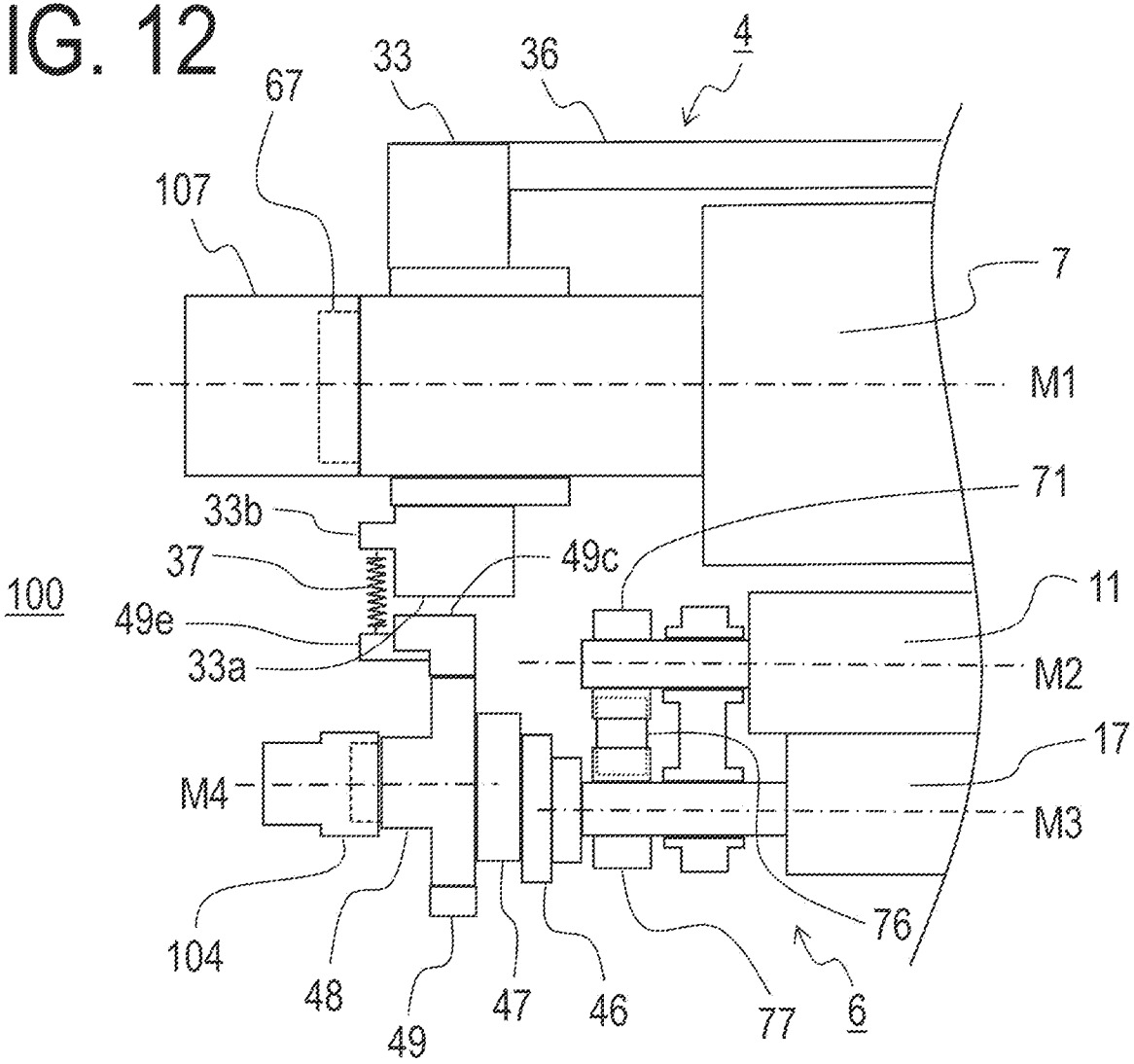
FIG. 12 is a schematic diagram depicting a driving mechanism between the apparatus main body and the process cartridge.
Figure 13:
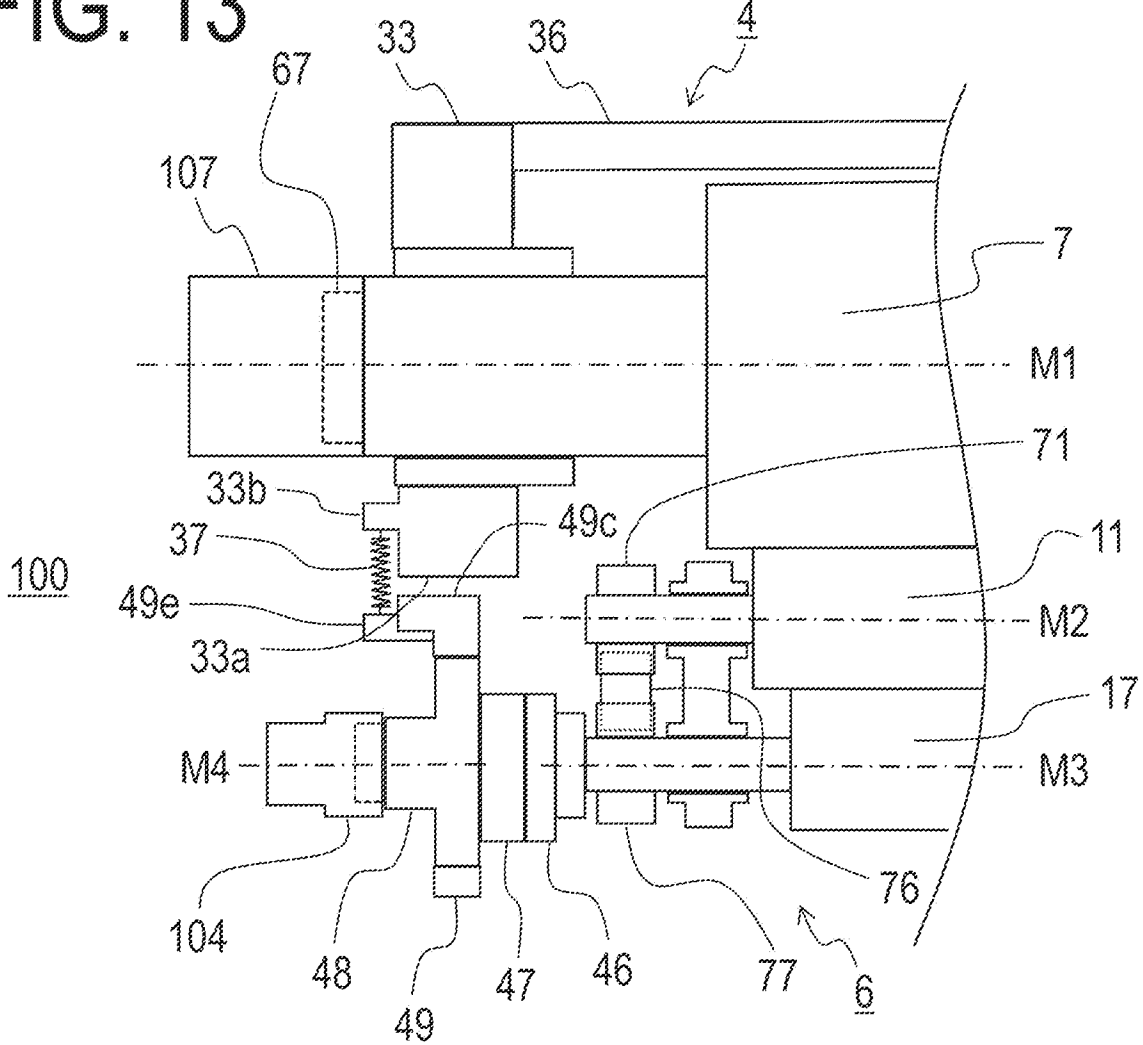
FIG. 13 is schematic diagram depicting a driving mechanism between the apparatus main body and the process cartridge.

The coupling configuration on the end portion of the feeding roller according to the present embodiment will be described with reference to FIG. 1 and FIGS. 8 to 13. FIG. 1 is a side view of the process cartridge on the driving side according to the present embodiment, and indicates a state where the photosensitive drum and the developing roller are separated. FIG. 8 is an exploded perspective view depicting a coupling configuration of the developing unit according to the present embodiment. FIG. 9 is a perspective view depicting the side face configuration on the driving side of the process cartridge according to the present embodiment. FIG. 10 is a side view of the process cartridge on the driving side according to the present embodiment, and indicates the state where the photosensitive drum and the developing roller are contacted. FIG. 11 is a schematic diagram of a cross-sectional configuration of the driving mechanism between the apparatus main body and the process cartridge according to the present embodiment, and indicates a state where the coupling is unengaged. FIG. 12 is a schematic diagram of a cross-sectional configuration of the driving mechanism between the apparatus main body and the process cartridge according to the present embodiment, and indicates a state where the coupling is engaged and the photosensitive drum and the developing roller are separated. FIG. 13 is a schematic diagram of a cross-sectional configuration of the driving mechanism between the apparatus main body and the process cartridge according to the present embodiment, and indicates a state where the coupling is engaged and the photosensitive drum and the developing roller are contacted.

As indicated in FIGS. 11 to 13, a main body side drum driving coupling 107 and a main body side development driving coupling 104 are disposed in the apparatus main body 100 for transmitting the rotary driving force to the process cartridge 1. On the other hand, a drum coupling 67 and a coupling member 48 are disposed in the process cartridge 1 for receiving the rotary driving force from the coupling on the main body side.

FIG. 11 indicates a state where the process cartridge 1 is in the middle of being attached to or removed from the apparatus main body 100, and a state before the main body side development driving coupling 104 is engaged with the coupling member 48 and the main body side drum driving coupling 107 is engaged with the drum coupling 67 respectively. In a state where the process cartridge 1 is removed from the apparatus main body 100, a contact portion (positioned portion) 49*c* of the coupling support member 49, which supports the coupling member 48, is contacted with a coupling holding portion (positioning portion) 33*a* of a drum support member 33 by a coupling pressing member 37. In this state, the rotational axial line M5 of the coupling member 48 and the rotational axial line M3 of the feeding roller 17 are parallel with each other, and are maintained at a predetermined interval in a direction perpendicular to the axial line. The predetermined interval here is set in a range where the coupling member 48 can be moved to a parallel position to engage with the main body side development driving coupling 104 using a guiding shape formed in the engaging portion of the main body side development driving coupling 104, which engages with the coupling member 48. The coupling member 48 constitutes an Oldham's coupling, with a later mentioned intermediate member 47 and a driving transmission member 46.

The process cartridge 1 is inserted into a process cartridge container portion of the apparatus main body 100, such that the driving side end portion in the longitudinal direction, where the coupling is disposed, enters first. Thereby, as indicated in FIG. 12, the coupling of the process cartridge 1 and the coupling of the apparatus main body 100 are engaged, which allows transmission of the driving force from the apparatus main body 100 to the process cartridge 1. In this state, the coupling member 48 parallel-shifts in the direction perpendicular to the rotational axial line direction, and engages with the main body side development driving coupling 104 using the guiding shape of the main body side development driving coupling 104. Thereby a contact portion 49*c* of the coupling support member 49 is separated from the coupling holding portion 33 a of the drum support member 33. FIG. 12 indicates a state where the process cartridge 1 is attached to the apparatus main body 100 (the couplings are engaged with each other, and attachment is completed), and the developing unit 6 (developing roller 11) is separated from the drum unit 4 (photosensitive drum 7). FIG. 13 indicates a state where the process cartridge 1 is attached to the apparatus main body 100 (the couplings are engaged with each other, and attachment is completed), and the developing unit 6 (developing roller 11) is contacted with the drum unit 4 (photosensitive drum 7).

The drum coupling 67 is disposed on one end side of the photosensitive drum 7 in the longitudinal direction, in order to transmit the driving force to the photosensitive drum 7. The drum coupling 67 engages with the main body side drum driving coupling 107 (drum driving output portion) of the apparatus main body 100. Then the driving force of a driving motor (not illustrated) of the apparatus main body 100 is transmitted to the photosensitive drum 7 via the above mentioned couplings, whereby the photosensitive drum 7 is rotated in the arrow A direction (see FIG. 3). The photosensitive drum 7 also includes a drum flange (not illustrated) on the other end in the longitudinal direction. The charging roller 8 is rotatably supported on the drum unit frame (drum frame) 5, so as to contact and rotate with the photosensitive drum 7. The rotational axial line M1 of the photosensitive drum 7 is parallel with the longitudinal direction of the process cartridge 1 and the longitudinal direction of the drum unit 108.

The coupling member 48 is disposed on a side of one end portion of the developing unit 6 in the longitudinal direction, in order to transmit the driving force to the developing unit 6. The coupling member 48 is a member which engages with the main body side development driving coupling 104 (developing driving output portion) of the apparatus main body 100, and is rotated by the rotary-driving force received from a driving motor (not illustrated) of the apparatus main body 100. The driving force received by the coupling member 48 is transmitted to the feeding roller 17, and is also transmitted to the developing roller 11 via a drive train (driving transmission gear 77, idler gear 76, developing roller driving gear 71), which is a driving transmission unit disposed in the developing unit 6. Thereby the developing roller 11 can be rotated in the arrow E direction indicated in FIG. 3, and the feeding roller 17 can be rotated in the arrow F direction indicated in FIG. 3.

As indicated in FIG. 8 and FIG. 11, the coupling of the developing unit 6 of the present embodiment is constituted of the driving transmission member 46, the intermediate member 47 and the coupling member 48.

The driving transmission member 46 is configured such that one end thereof is engaged with an edge core metal portion 17*a* of the feeding roller 17, and the other end thereof has a protruding portion 46*a* and is engaged with a first groove portion 47*a* of the intermediate member 47. An engaging portion (not illustrated) of the driving transmission member 46, which is engaged with the edge core metal portion 17*a*, has a shape to engage with the edge core metal portion 17*a*, so that the rotary driving force is transmitted to the edge core metal portion 17*a*. The intermediate member 47 includes the first groove portion 47*a* and a second groove portion 47*b*, which is formed in a direction perpendicular to the first groove portion 47*a*. The intermediate member 47 engages with both the coupling member 48 and the driving transmission member 46. The protruding portion 46*a* of the driving transmission member 46 engages with the first groove portion 47*a*, and a protruding portion 48*a*, formed on the coupling member 48, engages with the second groove portion 47*b*. These engaging portions are configured such that the direction in which the first groove portion 47*a* and the protruding portion 46*a* can slide with each other (second direction), and the direction in which the second groove portion 47*b* and the protruding portion 48*a* can slide with each other (first direction) intersect perpendicular to each other in the phase around the axial line that is parallel with the rotational axial line M3 of the feeding roller 17.

The coupling member 48 includes a driving force transmitted portion 48*b* (driving force receiving portion) on the opposite end portion of the end portion where the protruding portion 48*a*, which engages with the second groove portion 47*b* of the intermediate member 47, is formed, in the axial line direction, parallel with the rotational axial line M3. A driving force is transmitted from the main body side development driving coupling 104 of the apparatus main body 100 to the driving force transmitted portion 48*b*. The coupling member 48 includes a supported portion 48*c*, which is a shaft portion having the driving force transmitted portion 48*b* at the tip, and the supported portion 48*c* is rotatably inserted into a shaft hole 49*a* of the coupling support member 49. In other words, the coupling member 48 is supported by the coupling support member 49, so as to be rotatable around the axial line that is parallel with the rotational axial line M3.

The coupling support member 49 is installed on a side cover member 52 using engaged portions 49*b* and 49*d*, so as to be movable in a predetermined movable range in a direction perpendicular to the rotational axial line M3. The side cover member 52 is fixed at the driving side end portion of the developing frame 16 of the developing unit 6 in the longitudinal direction.

The engaged portion 49*b*, which is a boss portion (protruding portion) protruding in a direction parallel with the rotational axial line M3, is inserted into an engaging portion 52*a*, which is an arc-shaped long hole guide portion formed in the side cover member 52, in the direction parallel with the rotational axial line M3. The direction in which the engaging portion 52*a* guides the engaged portion 49*b* is a direction H along an arc track of which center is the rotation center (rotation support pin 30) of oscillation between the developing unit 6 and the drum unit 4. The relationship between the engaged portion 49*b* and the engaging portion 52*a* may be the reverse of the configuration of the present embodiment. In other words, a protruding portion as the engaged portion may be disposed on the side cover member 52, and a guide portion, in which the protruding portion fits, may be disposed in the coupling support member 49. In this configuration as well, the guiding track of the guiding portion becomes an arc track, of which center is the rotation center (rotation support pin 30) of oscillation between the drum unit 4 and the developing unit 6, in the state where a contact portion 49*c* of the coupling support member 49 is held by a later mentioned coupling holding portion 33*a* (positioned by being pressed against the coupling holding portion 33*a*).

The engaged portion 49*b*, which is a plate-shaped portion protruding in a direction perpendicular to the rotational axial line M3, and is inserted in the same direction into an engaging portion 52*b*, which is a groove-shaped guide portion which is depressed in the same direction. By this engaging configuration, the coupling support member 49 is configured to engage with the side cover member 52, and to be relatively movable to the side cover member 52 (developing frame 16) within a movable range in each engaging configuration, in the direction intersecting with the rotational axial line M3.

In other words, the coupling member 48 can relatively move to the feeding roller 17 in an arbitrary direction on a virtual plane that is perpendicular to the rotational axial line M3, by sliding on concave-convex interfitting portions connecting the driving transmission member 46, the intermediate member 47, and the coupling member 48 respectively. This relative movement is performed such that the rotational axial line M4 of the coupling member 48 shifts from the rotational axial line M3 in the direction intersecting with the rotational axial line M3, while maintaining the state of being parallel with the rotational axial line M3 of the feeding roller 17. Further, in the state where the process cartridge 1 is removed from the apparatus main body 100, the coupling support member 49 remains in the state of being pressed against the coupling holding portion 33*a* (being positioned) by the pressing force of the coupling pressing member 37, even if the relative position of the drum unit 4 and the developing unit 6 changes due to oscillation, as described later. In the state where the process cartridge 1 is attached to the apparatus main body 100, the coupling member 48 engages with the main body side development driving coupling 104, whereby the coupling support member 49 is separated from the coupling holding portion 33*a*. While the feeding roller 17 changes position depending on whether the developing roller 11 and the photosensitive drum 7 are separated (FIG. 12) or contacted (FIG. 13), the coupling member 48 remains in the state of being engaged with the main body side development driving coupling 104, and the driving transmission member 46 changes the position along with the feeding roller 17 (developing unit 6). In this state, the driving force transmitted from the main body side development driving coupling 104 can be transmitted to the feeding roller 17 by the rotation of the coupling member 48, and the sliding in the concave-convex interfitting portions connecting the driving transmission member 46, the intermediate member 47, and the coupling member 48.

As illustrated in FIG. 1, FIG. 9 and FIG. 10, the drum support member 33 is disposed on each end portion of the drum support frame 36 in the longitudinal direction, so as to rotatably support the photosensitive drum 7. The coupling holding portion 33*a*, to hold the coupling support member 49 when the process cartridge 1 enters the apparatus main body 100, and a later mentioned support portion 33*b* to support the coupling pressing member 37 (tension spring) are disposed in the drum support member 33. The coupling holding portion 33*a* is disposed to be contactable with the coupling support member 49 in the direction intersecting with the rotational axial line M2.

The coupling pressing member 37 is installed between a support portion 49*e* of the coupling support member 49 and the support portion 33*b* of the drum support member 33 after the developing unit 6 is supported by the drum unit 4, so as to be oscillatable. In the present embodiment, the tension spring is used as the coupling pressing member 37. The coupling pressing member 37, of which one end is connected with the drum support member 33 and the other end is connected with the coupling support member 49, applies the pressing force to press the coupling support member 49 against the coupling holding portion 33*a* in the direction intersecting with the rotational axial line M2 of the developing roller 11. Using the pressing force applied by the coupling pressing member 37, the coupling support member 49 is held and positioned by the above mentioned coupling holding portion 33*a* (positioning portion) in the state where the process cartridge 1 is removed from the apparatus main body 100. Thereby, as illustrated in FIG. 11, the coupling member 48, supported by the coupling support member 49, can be placed at a predetermined position (positioned at a predetermined position). Therefore when the process cartridge 1 is attached to the apparatus main body 100, the coupling member 48 can be stably engaged with the main body side development driving coupling 104 of the apparatus main body 100.

The coupling pressing member 37 is not limited to such an urging member as the tension spring. Other configurations may be used as long as the configuration can generate a pressing force (urging force) to press the contact portion 49*c* of the coupling support member 49 against the coupling holding portion 33*a* in a direction intersecting with the rotational axial line M2, between the drum support member 33 and the coupling support member 49. Further, the direction in which the pressing force of the coupling pressing member 37 is applied to the coupling support member 49 is a direction to make the coupling member 48 move closer to the drum coupling 67 here, but [the present invention] is not limited to this configuration.

As described above, the Oldham's coupling method is used in the present embodiment, hence the coupling member 48 is movable in the direction intersecting with the rotational axial line of the feeding roller 17. Therefore as illustrated in FIG. 12 and FIG. 13, the developing unit 6 can be moved to the first position or the second position, as mentioned above, in the state where the main body side development driving coupling 104 in the apparatus main body 100 and the coupling member 48 are engaged. Further, the coupling pressing member 37 is disposed between the coupling support member 49 and the drum support member 33, thereby the pressing force of the coupling pressing member 37 is not applied as a moment force around the rotation support pin 30. In other words, even if the pressing force of the coupling pressing member 37 is dispersed by the dispersion of component tolerance or the like, this dispersion does not influence the moment force around the rotation support pin 30. As mentioned above, in the present embodiment, the developing roller 11 is contacted with the photosensitive drum 7 using the moment force around the rotation support pin 30 generated by the pressing member of the apparatus main body 100. Therefore in the present embodiment, where the pressing force of the coupling pressing member 37 does not influence the moment force around the rotation support pin 30, the developing roller 11 can be stably pressed against the photosensitive drum 7.

In a conventional configuration, the pressing force (urging force), which is applied in the direction of pressing the coupling support member 49 against the coupling holding portion 33*a*, is generated by disposing a torsion coil spring between the side cover member 52 (developing frame 16) and the coupling support member 49, for example. Here in the state where the process cartridge 1 is attached to the apparatus main body 100, the drum unit 4 and the coupling member 48 are positioned (supported) by the apparatus main body 100. This means that the urging force of the torsion coil spring is applied to the developing frame 16. If the contacting/separating operation is performed in this state, the position of the developing unit 6, with respect to the coupling member 48 positioned in the apparatus main body 100, changes, and the operating state of the torsion coil spring changes due to the relative displacement of the coupling support member 49 and the developing frame 16, whereby a moment force is generated when the contacting/separating operation is performed. In the present embodiment, on the other hand, the pressing force (urging force) applied in a direction of pressing the contact portion 49*c* of the coupling support member 49 to the coupling holding portion 33*a* is applied using the tension spring, which is engaged with both the drum support member 33 (drum unit frame 5) and the coupling support member 49. If this configuration is used, the amount of change of the operating state of the coupling pressing member 37 (tension spring) is small, compared with the change in the orientation of the developing unit 6 caused by the contacting/separating operation. Therefore the movement force mentioned above is not generated very much. As a result, the contacting/separating operation of the developing roller 11 to/from the photosensitive drum 7 can be stabilized, and the developing roller 11 can be pressed against the photosensitive drum 7 stably.

In the description of the present embodiment, the present invention is applied to the process cartridge having a configuration in which the Oldham's coupling is disposed at the end portion of the feeding roller, but the configuration of the process cartridge is not limited to this. In other words, the present invention can also be suitably applied to the process cartridge having a configuration in which the Oldham's coupling is disposed at the end portion of the developing roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-167625, filed on Oct. 12, 2021, which is hereby incorporated by reference herein in its entirety.

What is claimed is:

1. A process cartridge detachably attached to an apparatus main body of an image forming apparatus, the process cartridge comprising:

a drum unit including a photosensitive drum and a drum frame configured to rotatably support the photosensitive drum; and a developing unit, the developing unit including:

a developing roller;

a developing frame configured to rotatably support the developing roller;

a driving transmission portion including a coupling member and a driving transmission member, where the coupling member (i) is disposed on a side of an end portion of the developing frame in a direction of a rotational axis of the developing roller, (ii) is rotatable, and (iii) receives a driving force to rotate the developing roller from the apparatus main body, the driving transmission member is rotatable and transmits the driving force transmitted from the coupling member to the developing roller, and the driving transmission portion is configured such that the coupling member and the driving transmission member are movable relative to each other in a direction intersecting the rotational axis; and a support member configured to rotatably support the coupling member and to be disposed movably with respect to the developing frame and the driving transmission member in the direction intersecting the rotational axis, wherein the developing frame and the driving transmission member are configured to be integrally movable between a contacted position and a separated position to/from the drum frame in the direction intersecting the rotational axis, wherein the developing roller is contacted to the photosensitive drum when the developing frame and the driving transmission member are at the contacted position, wherein the developing roller is separated from the photosensitive drum in a case where the developing frame and the driving transmission member are at the separated position, wherein the support member includes a positioned portion, wherein the drum frame includes a positioning portion, where the positioning portion positions the support member with respect to the drum frame by contacting with the positioned portion in the direction intersecting the rotational axis, and wherein the process cartridge includes an urging member that is engaged with both the support member and the drum frame such that the urging force is applied in a direction that the positioned portion of the support member and the positioning portion of the drum frame contact each other.

2. The process cartridge according to claim 1, wherein the positioned portion of the support member is contacted with the positioning portion of the drum frame, and the developing frame and the driving transmission member are at the separated position.

3. The process cartridge according to claim 2, wherein, in a state where the process cartridge is attached to the apparatus main body, the developing frame and the driving transmission member are movable between the contacted position and the separated position in a state where the positioned portion of the support member is separated from the positioning portion of the drum frame.

4. The process cartridge according to claim 1, wherein the support member is configured to be movable with respect to the developing frame in a direction along an arc-shaped track of which center is a rotation center of relative movement between the drum frame and the developing frame.

5. The process cartridge according to claim 4, wherein the support member includes a protruding portion that protrudes in a direction along the rotational axis of the developing roller, and wherein the developing frame includes a guide portion in which the protruding portion fits in the direction along the rotational axis of the developing roller, the guide portion extending along the arc-shaped track.

6. The process cartridge according to claim 1, wherein the urging member is a tension spring, and wherein one end of the tension spring is connected to the drum frame and the other end of the tension spring is connected to the support member.

7. The process cartridge according to claim 1, wherein the developing roller includes a gear on one end, and wherein the developing unit further comprises:

a developer containing portion that is disposed in the developing frame and contains developer;

a feeding roller that feeds the developer contained in the developer containing portion to the developing roller, one end of the feeding roller being connected to the driving transmission member, and the feeding roller being supported by the developing frame so as to be rotatable around a second rotational axis that extends in the direction of the rotational axis; and a driving transmission unit configured to transmit the driving force from the driving transmission member to the gear of the developing roller.

8. The process cartridge according to claim 1, wherein the driving transmission portion includes an intermediate member, which is engaged with both the coupling member and the driving transmission member, between the coupling member and the driving transmission member in the direction of the rotational axis, the driving transmission portion being configured such that the driving force is transmitted from the coupling member to the driving transmission member via the intermediate member, and wherein the intermediate member is movable with respect to the coupling member in a first direction that is perpendicular to the direction of the rotational axis, and the intermediate member is configured to be movable with respect to the driving transmission member in a second direction that is perpendicular to the direction of the rotational axis and the first direction.

9. The process cartridge according to claim 1, wherein the drum unit is disposed on an end portion of the drum frame on the same side as the coupling member in a direction of a rotational axis of the photosensitive drum, and the drum unit includes a drum coupling configured to receive a driving force to rotate the photosensitive drum from the apparatus main body, and wherein a direction in which the urging force of the urging member is applied to the support member is a direction in which the coupling member moves closer to the drum coupling.

* * * * *